United States Patent [19]

Habu et al.

[11] 4,145,218

[45] Mar. 20, 1979

[54] PROCESS FOR DEVELOPING LIGHT-SENSITIVE SILVER HALIDE PHOTOGRAPHIC MATERIALS

[75] Inventors: Teiji Habu; Masashi Nakano; Yasuo Tsuda; Eiichi Sakamoto; Hiroshi Yamada, all of Hino, Japan

[73] Assignee: Konishiroku Photo Industry Co., Ltd., Tokyo, Japan

[21] Appl. No.: 827,988

[22] Filed: Aug. 26, 1977

[30] Foreign Application Priority Data

Sep. 2, 1976 [JP] Japan ..... 51-105275

[51] Int. Cl.[2] ..... G03C 5/30; G03C 1/06; G03C 1/48

[52] U.S. Cl. ..... 96/66.3; 96/95; 96/107; 96/109; 96/50 PT

[58] Field of Search ..... 96/107, 109, 111, 95, 96/66.1–66.5, 50 PT

[56] References Cited

U.S. PATENT DOCUMENTS

| | | | |
|---|---|---|---|
| 2,438,716 | 3/1948 | Mueller | 96/109 |
| 2,521,926 | 9/1950 | Lowe et al. | 96/107 |
| 2,779,780 | 1/1957 | Middleton | 96/66 R |
| 2,955,036 | 10/1960 | Dersch et al. | 96/66.5 |
| 3,232,759 | 1/1966 | White | 96/109 |
| 3,419,392 | 12/1968 | Thompson | 96/107 |
| 3,615,528 | 10/1971 | Huckstadt | 96/66.3 |
| 3,708,302 | 1/1973 | Plakunov et al. | 96/107 |
| 3,824,103 | 7/1974 | Pierce | 96/109 |
| 3,869,289 | 3/1975 | Amering | 96/66 R |

*Primary Examiner*—Mary F. Kelley
*Attorney, Agent, or Firm*—Flynn & Frishauf

[57] ABSTRACT

Process for developing light-sensitive silver halide photographic materials with a developing solution in the presence of one or more of sulfur-containing amine compounds.

6 Claims, No Drawings

PROCESS FOR DEVELOPING LIGHT-SENSITIVE SILVER HALIDE PHOTOGRAPHIC MATERIALS

This invention relates to a process for developing a light-sensitive silver halide photographic material in the presence of a new compound.

Generally, the development of light-sensitive photographic materials is now performed by the automatic-roller-transfer system which comprises rapid development requiring a rather short period such as around five minutes. This period can, in some cases, be shortened to within two minutes. Yet, this rapid development involves such drawback as producing no photographic material of stabilized image of high quality. This is because the rapid development is apt to cause such undesirable phenomena as insufficiency of sensitivity, increase of fog and lack of uniformity of development, when compared with the conventional long period development at room temperature using a tank or a vat.

In view of the above-mentioned drawback, enhancement of sensitivity is now contemplated generally through improvement of developing performance by modification of the silver halide emulsion, employment of a known development accelerator or elevation of temperature for development.

Nevertheless, a satisfactory measure has not yet been produced by any of the above-cited procedures. More exactly, although enhancement of sensitivity can be achieved, degradation of the image happens due to formation of developed silver coarse grains, or increase of fog or decrease of sensitivity is caused during storage of the photographic materials. Thus, no practically applicable measure has appeared as yet.

Japanese Patent Provision Publication 13,917/72 discloses a silver halide emulsion containing an adduct of thioamine with $\alpha,\beta$-unsaturated aldehyde or the like. Yet, addition of these adducts to an emulsion layer will cause such troubles as deterioration of the sensitometory performance and increase of fog. Measures of incorporating cysteine into the emulsion and protective layers are previously known. But, incorporation of these agent will cause such drawback as poor preservability and heavy fog.

Enhancement of sensitivity and improvement of development performance are of very importance for photographic materials. Particularly, an X ray film for medical use requires such improved performance, for enabling observation of dark-fine parts with a smaller amount of exposure to X ray and for obtaining high-quality image within a shorter period. Further, in such case requiring more rapidity and high reliability as editing of information, photographic materials of high quality such as high sensitivity and good image reproducibility together with rapidity and uniformity are needed.

An object of this invention is to provide a development process of light-sensitive silver halide photographic materials whereby desired effective sensitivity is produced: that is, this involves enhancement of sensitivity of the silver halide photographic materials by way of increase of development rate with little fog and no deterioration of granularity.

Another object of this invention is to provide a development process of light-sensitive silver halide photographic materials whereby such high quality as little fog appearance and high sensitivity can be attained when high temperature and rapid procedure are adopted in a roller-transfer type automatic development system.

A further object of this invention is to provide a development process of X-ray sensitive photographic materials whereby the stable image reproducibility with high sensitivity and little fog is attained when direct or indirect type X-ray sensitive photographic materials are developed in a developing solution containing an aldehyde type hardening agent.

A still further object of this invention is to provide development conditions under which light-sensitive silver halide photographic materials of the aforementioned high quality can be obtained.

Other objects of this invention will appear hereinafter.

As a result of extensive researches, the present inventors have found that the above stated objects can be satisfied by developing a light-sensitive silver halide photographic material in the presence of one or more of sulfur-containing organic compounds having the following formula:

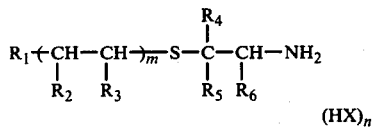

(I)

in which $R_1$ represents a substituted carbamoyl group, a cyano group, a nitrogen-containing heterocyclic group, —COOM or —COOR; each of $R_2$ and $R_3$ represents hydrogen, an alkyl group, a substituted or unsubstituted carbamoyl group, a cyano group, —COOM or —COOR; each of $R_4$ and $R_5$ represents hydrogen or an alkyl group; and $R_6$ represents hydrogen or —COOM; wherein M represents hydrogen or a cation, R represents a lower alkyl or aryl group and X represents an anion; and each of m and n is 0 or 1, and when M represents a cation, n is 0.

In the above formulae, a cation of M is exemplified by an alkali metal ion such as a sodium or potassium ion and an ammonium ion such as an ammonium, triethylammonium or pyridinium ion; a lower alkyl group of R is exemplified by methyl and ethyl group; and a substituent for the carbamoyl group can be an alkyl or aryl group.

Compound of the aforesaid formula are characterized in that the formula is represented by an amine structure containing a sulfur atom. It is assumed that the noticeable effect and function of the compounds of this invention are based on the existance of this structure.

Exemplified compounds employed in this invention will be shown below, but this invention is not limited by these compounds.

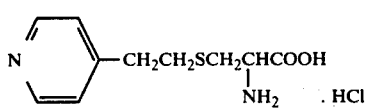

(1)

$(H_5C_2OOC)_2CHCH_2SCH_2CHCOOH$ (2)

$NC.CH_2CH_2SCH_2CHCOOH$ (3)

$H_3COCO.CHCH_2SCH_2CH_2NH_2$ (4)

-continued $H_5C_2OOC.CH(CN)CH_2SCH_2CH(NH_2)COOH \cdot HCl$ (5)

$NaOOC.CH_2.CH_2SCH_2CH(NH_2)COONa$ (6)

$H_5C_2NHC(=O).SCH_2CH_2NH_2$ (7)

$H_{23}C_{11}NHC(=O)S(CH_3)C(CH_3)(NH_2)COOH \cdot HCl$ (8)

$CH_2[NHC(=O)CH_2CH_2SCH_2CH_2NH_2]_2 \cdot 2HCl$ (9)

$H_{11}C_5NHC(=O)SCH_2CH(NH_2)COOH$ (10)

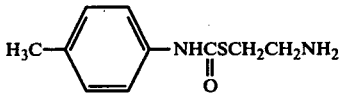

(11)

$H_2N.CH_2CH_2SC(=O)NH(CH_2)_6NHC(=O)SCH_2CH_2NH_2 \cdot 2HCl$ (12)

$H_5C_2SC_2H_4NHC(=O)SCH_2CH(NH_2)COOH \cdot HCl$ (13)

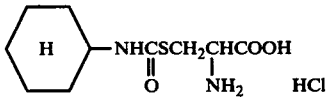

(14)

$H_{15}C_7NHC(=O)SCH_2CH(NH_2)COOH \cdot HCl$ (15)

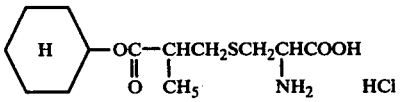

(16)

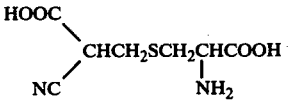

(17)

$HOOC-CH_2CH(HOOC)SCH_2CH(NH_2)COOH$ (18)

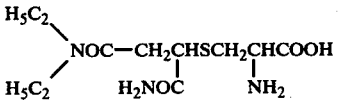

(19)

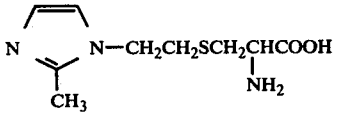

(20)

$NaOOC-CH_2CH(NC)SCH_2CH(NH_2)COONa$ (21)

The above-listed compounds can readily be prepared in the manners described in such publications as St. Guttman, Helv. Chim. Acta., 49, 83 (1966), L. Gershbein and C. D. Hurd, Org. Syn., Coll. Vol. III, 458 (1955), A. Schölurl, Chem. Ber., 80, 379 (1947), etc.

In practising the process of this invention, a compound of the aforementioned formula (I) must be present when a light-sensitive silver halide photographic material is being developed. Measures for incorporating the compounds are exemplified by: the compound is incorporated into the light-sensitive silver halide photographic material in advance; the compound is incorporated into the developing solution; and the compound is incorporated into a pre-treating solution in a stage prior to development treatment. In the case of the advance incorporation of the compound into the light-sensitive silver halide photographic material, namely, the first case, the compound may be introduced into a protective layer, an intermediate layer, a underlayer or a filter layer adjacent to the silver halide emulsion layer as well as into the silver halide emulsion layer directly. Thus, development acceleration effect can be attained with little fog.

Light-sensitive silver halide photographic materials to which the present invention is applicable comprise several types of materials. For instance, this invention is optionally applicable to general black-white, X-ray, color, printing-use, copying, diffusion transfer type, silver dye bleaching and specific type photographic materials. Particularly, when this invention is applied to an X-ray sensitive photographic material, that is, when said material is developed in a developing solution containing an aldehyde-type hardening agent under the conditions of this invention, the effect is very prominent. As the silver halide employed in the present light-sensitive silver halide photographic materials, there can be mentioned silver bromide, silver chloride, silver chlorobromide, silver iodobromide and silver iodochlorobromide. Those silver halide emulsions can be chemically sensitized in the usual manner. For instance, the sulfur sensitization using sodium thiosulfate, allylthiocarbamide, thiourea, allylthiocyanate or the like, and the noble metal sensitization using potassium chloroplatinate, ammonium chloropalladinate, a noble metal salt such as of ruthenium, rhodium, iridium or platinum or the like can be adopted. Further, a noble metal salt and a sulfur sensitizer can be used in combination, and ammonium rhodanate can likewise be used in combination with said sensitizers. The selenium sensitization using selenourea, N,N-dimethylselenourea, N,N-dimethylurea or the like which are disclosed in U.S. Pat. Nos. 1,574,944, 3,591,385 Japanese Patent Publication (J.P.P.) 13,849/68 and J.P.P. 15,748/69 can be used. The reduction sensitization using a tin salt disclosed in U.S. Pat. No. 2,487,850, a polyammine disclosed in U.S. Pat. No. 2,518,698 and U.S. Pat. No. 2,521,925, or a quaternary ammonium salt disclosed in U.S. Pat. Nos. 2,334,864, 2,271,623, 2,288,226, and 2,708,162 can be utilized as well. A sensitization method using a polyalkylene oxide as disclosed in Japanese Patent Publications 13,822/68, 8,742/72, 11,116/72 and 378/65 Japanese Patent Provision Publications 19,213/73, 10,722/74, 74,929/74, 13,072/74 and 57,427/75, Japanese Patent Application 73,121/74, U.S. Pat. Nos. 2,240,472, 1,970,753, 2,400,532, 2,423,549, 2,441,389, 3,017,271, 3,062,647, 2,312,553 and 3,026,202, and British Pat. No. 805,826 can be utilized. Further, a sensitization method using a thioether as disclosed U.S. Pat. No. 3,021,215, British Pat. No. 1,163,429 and J.P.P 1,116/72 can also be employed.

When the above-exemplified sensitization is carried out, the sensitization of the present invention using the now disclosed development accelerator can effectively be applied to result in enhanced sensitization and accelerated development rate.

The silver halide emulsion of this invention can be imparted sensitivity to light of desired wave length region by the use of a sensitizing dye. A variety of sensitizing dyes can be utilized singly or in combination for the above purpose. Methine and styryl dyes such as cyanine, hemicyanine, rhodacyanine, merocyanine, oxonole and hemioxonole can be advantageously employed in the present invention. Representative examples of the above dyes are disclosed in U.S. Pat. Nos. 1,846,301, 1,846,302, 1,939,201, 1,990,507, 2,072,908, 2,112,140 2,165,338, 2,269,234, 2,270,378, 2,442,710, 2,454,629, 2,493,748, 2,503,776, 2,519,061, 2,666,761, 2,739,149, 2,739,964 and 2,945,763, British Pat. Nos. 424,559, 450,958 and 505,979, German(West) Patents 929,080 and 2,049,967, Japanese Pat. Publications 10,251/68, 10,252/68, 13,821/68, 32,753/69, 27,672/70, 27,674/70, 27,675/70, 18,106/71, 18,108/71, 8,741/72, 23,573/72 and 37,443/72, Japanese Patent Provisional Publication 89,722/73, "The Theory of the Photographic Process," 3rd Edition (Mees, James, 1966, The MacMillan Co.) and "Cyanine Dye and Related Compounds" (Hamer, 1964, Interscience Publishers). Sensitizing dyes particularly effective for the present invention are those disclosed in U.S. Pat. Nos. 2,213,995, 2,503,776 and 2,945,763, German(West) Pat. 929,080, 2,049,967, Japanese Patent Publications 13,821/68 32,753/69, 18,106/71, 8,741/72 and 37,443/72, and Japanese Patent Provisional Publication 89,722/73.

Concrete examples of these dyes are 3,3'-di-(3-sulfopropyl) selenacarbocyanine hydroxide, 5,5'-diphenyl-3,3'-di-(3-sulfopropyl)oxacyanine hydroxide, 3-allyl-5-[1-methyl-2(1H) piperidylidene]rhodanin, 3-(4-sulfobutyl)-1'-ethyl-6'-methylselena-2'-cyanine hydroxide, 1-hydroxyethyl-3-phenyl-5-[3-(3-sulfopropyl)-2-benzoxazoliniden]ethylydene-2-thiohydantoin sodium salt, 5,5'-dichloro-9-ethyl-3,3'-di-(3-sulfopropyl)oxacarbocyanine hydroxide, 5,5'-diphenyl-9-ethyl-3,3'-di-(3-sulfopropyl)oxacarbocyanine hydroxide, 5,5',6,6'-tetrachloro-1,1'-diethyl-3,3'-di-(4-sulfobutyl)benzoimidazolocarbocyanine hydroxide sodium salt, 5,5'-di-(butoxycarbonyl)-1,1'-diethyl-3,3'-di-(3-sulfopropyl)benzoimidazolocarbocyanine hydroxide, 5,5'-dichloro-1,3-diethyl-6'-methyl-3-(4-sulfobutyl)benzoimidazoloxacarbocyanine hydroxide, 5,5'-dichloro-9-ethyl-3,3'-(dicarboxyethyl)thiacarbocyanine hydroxide, 5,5'-dichloro-3,9-diethyl-3'-(3-sulfopropyl)thiacarbocyanine hydroxide, 5,5'-dimethyl-9-ethyl-3,3'-di-(3-sulfopropyl)thiacarbocyanine hydroxide, 9-ethyl-3,3'-di-(3-sulfopropyl)-4,5,4',5'-dibenzothiacarbocyanine hydroxide, and 9-ethyl-3,3'-di-(3-sulfopropyl)-5,6,5',6'-dibenzoxacarbocyanine hydroxide.

To the silver halide emulsion of this invention there may be added a stabilizer and an antifoggant as disclosed in U.S. Pat. Nos. 2,444,607, 2,716,062, 3,512,982 and 3,342,596, German(West) Patents 1,189,380, 2,058,626 and 211,841, Japanese Patent Publications 4,133/68 and 2,825/64, and Japanese Patent Provision Publications 22,626/75 and 25,218/75. Most preferred are 5,6-trimethylene-7-hydroxy-5-triazolo (1,5-a)pyrimidine, 5,6-tetramethylene-7-hydroxy-5-triazolo(1,5-a)pyrimidine, 5-methyl-7-hydroxy-5-triazolo(1,5-a)-pyrimidine, gallic acid esters such as isoamyl gallate, dodecyl gallate, propyl gallate and sodium gallate, mercaptans such as 1-phenyl-5-mercaptotetrazole and 2-mercaptobenzothiazole, benzotriazoles such as 5-bromobenzotriazole and 4-methylbenzotriazole, and benzoimidazoles such as 6-nitrobenzoimidazole.

Photographic gelatin hardening agents which can be applied in a coating solution to a light-sensitive silver halide photographic material according to this present invention can be aldehydes, azilidines as disclosed for instance, in PB Report 19,921, U.P. Pat. Nos. 2,950,197, 2,964,404, 2,983,611 and 3,271,175, J.P.P. 40,898/71 and Japanese Patent Provisional Publication (J.P.P.P.) 91,315/75, isoxazoles, epoxy compounds as desclosed, for instance in U.S. Pat. No. 3,047,394, German(West) Pat. No. 1,085,663, British Pat. No. 1,033,518 and J.P.P. 35,495/73, vinylsulfone compounds as disclosed, for instance, in PB Report 19,920, German(West) Pat. No. 1,100,942, British Patent 1,251,091 and 3,490,911 and Japanese Patent Applications 54,236/70 and 110,996/73, acryloyl compounds as disclosed, for instance, in U.S. Pat. No. 3,640,720 and Japanese Patent Application 27,949/73, carbodiimides as disclosed, for instance, in U.S. Pat. No. 2,938,892, J.P.P. 38,715/71 and Japanese Patent Application 15,095/74, maleimides, acetylenes, methanesulfonic acid esters, triazines and polymers.

Thickening agents as disclosed, for instance, in U.S. Pat. No. 3,767,410 and Belgian Pat. No. 558,143, gelatin plasticizers such as polyols as disclosed in U.S. Pat. No. 2,960,404, J.P.P. 4,939/68 and J.P.P.P. 63,715/73, and latexes as disclosed, for instance, French Pat. No. 1,395,544 and J.P.P. 43,125/73 can likewise be involved.

Matting agents are disclosed in British Pat. No. 1,221,980, and gelatin derivatives are, for instance, phenylcarbamylgelatin, acylated gelatin and phthalated gelatin as disclosed in U.S. Pat. Nos. 2,614,928 and 2,525,753 and graft-polymerized gelatin with a polymerizable monomer having ethylene groups such as styrene acrylate, acrylic acid ester, methacrylic acid and methacrylic acid ester as disclosed in U.S. Pat. Nos. 2,548,520 and 2,831,767. These hydrophilic colloids can be used as components of a protective layer, an intermediate layer, a filter layer and other photographic materials.

Extenders and coating agents which can be used as components of light sensitive silver halide photographic materials of this invention can be saponin and succinic acid type surfactants as disclosed in British Pat. No. 548,532 and Japanese Patent Application 89,630/72, anionic surfactants as disclosed in J.P.P. 13,166/68 and U.S. Pat. No. 3,514,293 and those as disclosed in French Pat. No. 2,025,688 and J.P.P. 10,247/68.

In the process of this invention there can be used binders such as gelatin-colloidal albumin, agar, gum arabic, alginic acid, hydrolyzed cellulose acetate, acrylamide, imidized polyamide, polyvinylalcohol, hydrolyzed polyvinyl acetate and water-soluble polymers as disclosed in British Pat. No. 523,611, German(West) Pat. Nos. 2,225,711 and 2,046,682 and U.S. Pat. No. 3,341,332.

When the present invention is applied to a color photographic material, a variety of couplers can be employed: for instance, a yellow coupler such as an open-chain ketomethylene type coupler, magenta couplers such as pyrazolone, pyrazolotriazole, pyrazolobenzimidazole and imidazolone types, and cyan couplers such as phenol and naphthol types, colored magenta couplers, colored cyan couplers, development inhibitor releasing couplers, development inhibitor releasing compounds, Weiss couplers, competing couplers.

Further, a ultra-violet ray absorber such as Tinuvin® as disclosed in Japanese Patent Publications 763/73 and 41,572/73, a fluorescent whitening agent, an image stabilizer, an anti-oxidizing agent, a lubricant, a metal ion chelating agent, an emulsifier, and a dispersant can also be employed.

The light-sensitive silver halide photographic material employed in the present invention may comprises a protective layer, intermediate layer, filter layer, anti-halation layer, underlaying layer, sub layer, anti-irradiation layer, anti-curling layer, etc., in addition to the silver halide emulsion layer. The support employed in this invention includes paper, polyethylene-laminated paper polypropylene paper, glass, cellulose acetate, cellulose nitrate, polyvinylacetal, polypropylene, polyester film such as polyethylene terephthalate, polyamide film, polycarbonate film, polystyrene film, and the like. These supports can be selected in accordance with the intended use of the photographic material.

The developing solution can be a conventional one and the developing agent used in the solution can be one or a combination of hydroquinone, N-methyl-p-aminophenol, 1-phenyl-3-pyrazolidone, p-phenylenediamine and the like. The developing solution may contain an alkali agent such as sodium carbonate, potassium carbonate, sodium hydroxide, potassium hydroxide, sodium metaborate, alkanolamine, etc. a preserving agent such as sodium sulfite, potassium sulfite, sodium hydrogensulfite, potassium pyrosulfite, formaldehyde, sodium hydrogensulfite adduct, etc., and a anti-foggant such as an azole compound, e.g., 5-nitrobenzoimidazole, 5-methylbenzotriazole, 8-nitrobenzotriazole and 1-phenyl-5-mercaptotetrazole. A hardening agent of a known aldehyde type which can harden gelatin and other polymers may be included. Preferred aldehydes are dialdehydes such as glutaric aldehyde, maleic aldehyde and their hydrogensulfites. In addition, the developing solution can contain and anti-oxidizing agent such as 3,6-dihydroxypyridazine as disclosed in J.P.P.P. 76,601/73, a polyamine such as disclosed in J.P.P.P. 41,803/73, an organic solvent such as polyalkylene oxide, an alkylene glycol, an alcohol, e.g., methyl alcohol, dimethylformamide, cellosolve, or benzylalcohol, and ascorbic acid, if desired. Further, a chelating agent, a pH regulator and a buffer solution can likewise be included.

The developing period(time) varies depending upon kind of the developing solution, developing temperature and nature of the photographic material, but generally around or longer than five minutes or from about five seconds to one minutes is suitable. The development can be carried out in a vat or in a rapid automatic device for the roller-transfer system.

The compound of this invention is preferably added in an amount of $10^{-6}$—$10^{-3}$ moles per one mole of the silver halide when the compound is directly incorporated into the silver halide emulsion. The compound can be added in any stage of preparation of the emulsion, but preferably and readily be added with the desired result of little for when the second ripening stage is terminated. When the compound is incorporated into layers adjacent to the silver halide emulsion layer, the dosage is almost the same or a little more as compared with the case of the direct addition to the emulsion layer. This means that the compound ought to be contained in almost the same amount in the unit area wherever the compound is incorporated. The addition can be conducted in any stage, but preferably in advance of the coating. When the compound is to be added to the developing solution, it is added in the stage for preparation of the developing solution or in advance of the development. In this case, the compound can be added directly to the developing solution to dissolve therein or after being dissolved in water or a hydrophilic organic solvent. The dosage varies depending upon kinds of the employed compound, the developing solution and the photographic material, but a wide range of the dosage such as from 0.01 to 5 g/one liter of a developing solution can be adopted. When the compound is included in a pre-treatment solution prior to development, the similar manner can be adopted to adjust the solution.

As described hereinbefore, a light-sensitive slilver halide photographic material of high sensitivity, high quality with little fog that is contemplated by this invention can be obtained.

For more detailed description of this invention, the following examples are illustrated, but no limitation to this invention is intended by these examples.

EXAMPLE 1

A high-sensitive X ray film coated on both sides with a silver iodobromide emulsion was sensitometrically exposed, and developed at 20° C. for 4 minutes in a developing solution of the following composition.

| Developing Solution A | | |
|---|---|---|
| Metol | 3.5 | g |
| Anhydrous sodium sulfite | 60 | g |
| Hydroquinone | 9 | g |
| Sodium carbonate (monohydrate) | 53 | g |
| Potassium bromide | 2.5 | g |
| Water to make | 1 | liter |

Developing Solution B

Prepared in the same manner as in Developing Solution A, but 1 g/l of the exemplified compound (2) was further added.

Developing Solution C

Prepared in the same manner as in Developing Solution A, but 1 g/l of the exemplified compound (12) was further added.

The results are shown in Table 1, in which sensitivity is expressed by a relative value as compared with the value obtained in Developing Solution A containing no compound of this invention.

Table 1

| Developing Solution | Amount added (/l) | Fog | Relative Sensitivity | Contrast | $D_{max}$* |
|---|---|---|---|---|---|
| A | None(Control) | 0.12 | 100 | 3.08 | 3.1 |
| B | Compound (2) 1 g | 0.13 | 130 | 3.20 | 3.4 |
| C | Compound (12) 1 g | 0.12 | 120 | 3.32 | 3.3 |

*: $D_{max}$ = Max Density

As seen from Table 1, the relative sensitivity of the developing solutions containing the compounds of this invention is higher than that of the control solution by over 20–30%. This means that the development period needed can be shortened by over 20–30%. Further, the present invention can provide no decrease of either contrast (gamma) of $D_{max}$. Such decrease often occurs in the case using the conventional development accelerating agent.

EXAMPLE 2

This example shows a case in which the present invention was applied to a high temperature rapid developing solution containing glutaric aldehyde.

| Developing Solution D | | |
|---|---|---|
| Hydroquinone | 10 | g |
| 1-Phenyl-1,3-pyrazolidone | 0.4 | g |
| Anhydrous sodium sulfite | 70 | g |
| Sodium carbonate (monohydrate) | 20 | g |
| Boric anhydride | 20 | g |
| Sodium hydroxide | 5 | g |
| 5-Methylbenzotriazole | 0.05 | g |
| Potassium bromide | 5 | g |
| Gulutaric aldehyde hydrogen sulfite | 15 | g |
| Gracial acetic acid | 8 | g |
| Water to make | 1 | liter |

Developing Solution E

Prepared in the same manner as in Developing Solution D, but 1 g/l of the exemplified compound (4) was further added.

Developing Solution F

Prepared in the same manner as for Developing Solution D, but 1 g/l of the exemplified compound (11) was further added.

Developing Solution G

Prepared in the same manner as for Developing Solution D but the gulutaric aldehyde hydrogensulfite was excluded therefrom. This solution was tested as a control.

Developing Solution H

Prepared by adding 1 g/l of the exemplified compound (4) to the Developing Solution G.

Developing Solution I

Prepared by adding 1 g/l of the exemplified compound (11) to the Developing Solution G.

An X ray film of the same type prepared in Example 1 was sensitometrically exposed, and developed at 35° C. for 30 seconds with six kinds of the developing solutions of the compositions described above.

The results are shown in Table 2, in which Relative Sensitivity and $D_{max}$ mean the same as in Example 1.

Table 2

| Developing Solution | Amount added (/l) | Fog | Relative Sensitivity | Contrast | $D_{max}$ |
|---|---|---|---|---|---|
| D | None (Control) | 0.11 | 100 | 3.40 | 3.3 |
| E | Compound(4) 1 g | 0.12 | 150 | 3.60 | 3.4 |
| F | Compound(11) 1 g | 0.11 | 140 | 3.65 | 3.5 |
| G | None (Control) | 0.12 | 107 | 3.60 | 3.4 |
| H | Compound(4) 1 g | 0.12 | 120 | 3.72 | 3.5 |
| I | Compound(11) 1 g | 0.12 | 115 | 3.80 | 3.5 |

As seen from Table 2, compounds of the present invention can prominently improve sensitivity, contrast and $D_{max}$ when employed in a high temperature rapid developing solution. Particularly, the compound of the present invention provides excellent development acceleration when employed with glutaric aldehyde.

EXAMPLE 3

The compound of the present invention listed in Table 3 was added in an aqueous or methanol solution to a negative silver iodobromide emulsion containing 3 mole percent of silver iodobromide at the time of termination of the second riping stage. The resulting emulsion was, after adjusted, coated on a cellulose triacetate film base and dried to obtain a test sample. The sample was sensitometrically exposed, and developed at 35° C. for 30 seconds in Developing solution D stated in Example 2.

The resulting photographic properties are shown in Table 3. The sensitivity value is expressed in relative sensitivity where the value obtained with no compound of the present invention is putted as 100.00.

Table 3

| Sample | Amount added (mg/l mol of silver halide) | Fog | Relative Sensitivity |
|---|---|---|---|
| Blank | None (Control) | 0.12 | 100 |
| Compound (1) | 5 | 0.12 | 120 |
| | 10 | 0.13 | 130 |
| | 20 | 0.13 | 120 |
| Compound (16) | 5 | 0.12 | 115 |
| | 10 | 0.13 | 125 |
| | 20 | 0.13 | 110 |
| Compound (21) | 5 | 0.12 | 140 |
| | 10 | 0.12 | 135 |
| | 20 | 0.13 | 130 |

As seen from Table 3, a silver halide emulsion containing a compound of the present invention provides improved sensitivity with less fog as compared with the emulsion comprising the conventional development accelerator.

EXAMPLE 4

To a positive silver iodochlorobromide emulsions, which was prepared in a conventional manner, was added a blue-sensitive emulsion containing an appropriate amount of a dispersion of a yellow coupler, 2-pivalyl-2-[4-(4-benzyloxyphenylsulfonyl)phenoxy]-2-chloro-5-[γ-(2,4-di-t-amylphenoxy)butylamido]-acetanilide. The resulting mixture was coated on a polyethylene laminated paper. On this layer was coated gelatin alone to form an intermediate layer. Further, an ortho-sensitive silver chlorobromide containing 30 mole percent of silver chloride and an appropriate amount of a dispersion of a magenta coupler, 1-(2,4-dimethyl-6-chlorophenyl)-3-[3-{2-(m-pentadecylphenoxy)butylamido}benzamido]-5-pyrazolone was coated thereon. At last, a gelatin intermediate layer was again formed thereon to compose a multilayer film.

To some emulsions as the ortho emulsions were added the exemplified compounds (1) and (19), respectively, in the amounts shown in Table 4. A blank emulsion containing no compound of the present invention was also prepared for the use as a control. To thus obtained three emulsions were respectively added a cyan coupler, 2-(4-di-t-amyl-3'-phenoxybenzoylamino)-3-methyl-1-phenol in the amount of 0.1 mole based on one mole of the silver halide. Thus, three different red-sensitive emulsions containing cyan couplers were prepared. Each of the emulsions was separately coated on three set of the multilayer films prepared previously. Gelatin protective layer was further formed on the layer to obtain three different sets of photographic materials for color print use.

These samples were sensitometrically exposed, and color-developed at 38° C. for 3 minutes and 15 seconds in a color-developing solution of the composition shown below. Conventional bleaching, fixing, washing and drying were subsequently carried out. Sensitivity and fog of the red-sensitive emulsion forming the cyan dye layer were sensitometrically determined.

The results are shown in Table 4, in which the sensitivity is expressed in a relative value as compared with the obtained value of the control.

| Developing Solution J (Color-developing solution) | |
|---|---|
| Anhydrous sodium hydrogen carbonate | 29.5 g |
| Potassium sulfite (dihydrates) | 2.0 g |
| Potassium bromide | 1.3 g |
| Sodium nitrilotriacetate (monohydrate) | 2.0 g |
| Potassium hydroxide | 0.4 g |
| Hydroxylamine sulfate | 2.0 g |
| 4-Amino-3-methyl-N-methyl-(β-hydroxyethyl)aniline sulfate | 5.0 g |
| Water to make | 1 liter |

As seen from Table 4, the compound of the present invention provides a high-sensitive photographic material with little fog (contamination) even if a color coupler is together employed.

Table 4

| Sample | Amount added (mg/l mol of silver halide) | Fog | Relative Sensitivity |
|---|---|---|---|
| Blank | None (Control) | 0.03 | 100 |
| Compound (1) | 100 | 0.03 | 135 |
| Compound (19) | 100 | 0.03 | 140 |

EXAMPLE 5

This example shows a case in which a compound of the present invention is incorporated into a protective layer adjacent to a light-sensitive silver halide layer. An emulsion for X ray film prepared by a conventional method was coated on a polyethylene terephthalate film support so that silver content on the film support was 50 mg/m$^2$. Five parts of 3% aqueous gelatin solution were prepared. One part of the gelatin solution was coated on the above-obtained multilayer material to form a protective layer in which gelatin content was 16 mg/m$^2$. To each of the remaining four parts of the gelatin solution was added a compound of the present invention listed in Table 5, and then each of the resulting mixtures was coated to form a multilayer in the manner as described above.

The obtained sample was sensitometrically exposed, and rapidly developed at 35° C. in Developing solution D described hereinbefore.

As seen from Table 5 shown below, samples comprising compounds of the present invention needs only about one-twice of developing time to reach the same relative sensitivity as compared with a sample containing no such compound being developed with Developing solution D for 100 seconds.

Table 5

| Sample | Amount added (mg/m$^2$) | Fog* | Relative Sensitivity* | Development time** |
|---|---|---|---|---|
| Blank | None | 0.13 | 100 | 100 sec. |
| Compound (4) | 0.1 | 0.14 | 180 | 55 |
| Compound (5) | 0.1 | 0.13 | 170 | 60 |
| Compound (11) | 0.1 | 0.14 | 140 | 70 |

Table 5-continued

| Sample | Amount added (mg/m$^2$) | Fog* | Relative Sensitivity* | Development time** |
|---|---|---|---|---|
| Compound (20) | 0.1 | 0.13 | 160 | 64 |

*Determined when developed for 100 sec.
**Time required to reach a Relative Sensitivity of 100.

EXAMPLE 6

On a surface layer of a process lith film comprising silver iodochlorobromide gelatin emulsion was coated 3% gelatin solution containing a compound of the present invention listed in Table 6 to form a protective layer. The obtained sample was sensitometrically exposed and developed at 20° C. in a developing solution of the following composition.

| Developing Solution K | |
|---|---|
| Hydroquinone | 16 g |
| Sodium formaldehyde bisulfite | 50 g |
| Anhyrdrous sodium sulfite | 2 g |
| Boric anhydride | 2 g |
| Sodium carbonate (monohydrate) | 60 g |
| Potassium bromide | 1 g |
| Triethylene glycol | 40 g |
| Water to make | 1 liter |

The above formulated developing solution generally requires 2 minutes and 30 seconds of development time. When a compound of the present invention is included in the photographic material, however, the development time shortens with no deterioration of the contrast and dot-formation, as shown in Table 6.

Table 6

| Sample | Amount added (mg/m$^2$) | Development time* | |
|---|---|---|---|
| Blank | None (Control) | 2 min. | 30 sec. |
| Compound (9) | 0.5 | 1 | 40 |
| Compound (13) | 0.5 | 1 | 30 |

*Development time necessary to obtain a relative sensitivity of 100

EXAMPLE 7

This example relates to preservativity of a photographic material.

The procedure stated in Example 5 was repeated to prepare 3 sets of X ray-sensitive photographic materials, each of which contained a compound of the present invention listed in Table 7 within the protective layer. Separately, a blank sample containing no such compound was prepared in the same manner. Further, two sets of samples containing L-cysteine disclosed in J.P.P.P. 13,917/72 were prepared in the same manner and named Ref. S. The latter three samples were submitted to measurement as controls. Thus, six sets of the photographic material were prepared.

The obtained samples were allowed to stand for two days and then for two days at 55° C. and at the relative humidity (RH) of below 80%. Subsequently, these were sensitometrically exposed and developed in the manner as stated in Example 5.

As seen from Table 7 shown below, the samples according to the present invention provides better preservativity than the control samples.

Table 7

| Compound | Amount added ($mg/m^2$) | Fog* | Relative Sensitivity* | Fog** | Relative Sensitivity** |
|---|---|---|---|---|---|
| Blank | None | 0.13 | 100 | 0.14 | 98 |
| Ref. S | 0.1 | 0.14 | 150 | 0.35 | 94 |
| Compound (6) | 0.1 | 0.13 | 150 | 0.15 | 140 |
| Compound (7) | 0.1 | 0.14 | 140 | 0.15 | 145 |
| Compound (12) | 0.1 | 0.14 | 130 | 0.16 | 130 |
| Compound (20) | 0.1 | 0.13 | 140 | 0.14 | 135 |

*After allowed to stand for 2 days at room temperature

**After allowed to stand for 2 days at 55° C and R.H. 80%.

What is claimed is:

1. A process for developing an image-wise exposed light-sensitive silver halide photographic material with a developing solution containing an aldehyde hardening agent in the presence of one or more of compounds having the following formula:

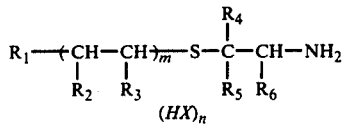

in which $R_1$ represents a substituted carbamoyl group, a cyano group, a nitrogen-containing 5–10 membered heterocyclic group, —COOM or —COOR; each of $R_2$ and $R_3$ represents hydrogen, an alkyl group, a substituted or unsubstituted carbamoyl group, a cyano group, —COOM or —COOR; each of $R_4$ and $R_5$ represents hydrogen or an alkyl group; and $R_6$ represents hydrogen or —COOM; wherein M represents hydrogen, an alkali metal or ammonium ion, R represents a lower alkyl or aryl group; X represents a chlorine ion; and each of m and n is 0 or 1, and when M represents an alkali metal or ammonium ion, n is 0, said compound being present in the photographic material or in the developing solution.

2. A process for developing a light-sensitive silver halide photographic material as claimed in claim 1 in which said compound is selected from the group consisting of

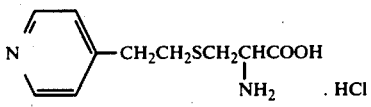

(1)

$(H_5C_2OOC)_2CHCH_2SCH_2CH(NH_2)COOH$ (2)

$NC.CH_2CH_2SCH_2CH(NH_2)COOH$ (3)

-continued $H_3COCO.CH(CH_3)CH_2SCH_2CH_2NH_2$ (4)

$H_5C_2OOC.CH(CN)CH_2SCH_2CH(NH_2)COOH.HCl$ (5)

$NaOOC.CH_2.CH_2SCH_2CH(NH_2)COONa$ (6)

$H_5C_2NHC(=O).SCH_2CH_2NH_2$ (7)

$H_{23}C_{11}NHC(=O)SC(CH_3)(CH_3)CH(NH_2)COOH.HCl$ (8)

$CH_2[NHC(=O)CH_2CH_2SCH_2CH_2NH_2]_2$ 2HCl (9)

$H_{11}C_5NHC(=O)SCH_2CH(NH_2)COOH$ (10)

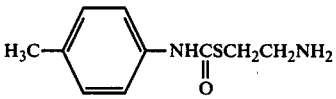

(11)

$H_2N.CH_2CH_2SC(=O)NH(CH_2)_6NHC(=O)SCH_2CH_2NH_2$ 2HCl (12)

3. A process for developing a light-sensitive silver halide photographic material as claimed in claim 2 in which said compound is incorporated in an amount of $10^{-6}$ to $10^{-3}$ mole per one mole of silver halide.

4. A process for developing a light-sensitive silver halide photographic material as claimed in claim 3 in which said compound is added in an amount of 0.01 to 5 g per one liter of the developing solution.

5. A process for developing a light-sensitive silver halide photographic material as claimed in claim 1 in which said compound is incorporated into a protective layer in an amount of $10^{-6}$ to $10^{-3}$ mole per one mole of silver halide.

6. A process for developing a light-sensitive silver halide photographic material as claimed in claim 5 in which said compound is selected from the group consisting of $(H_5C_2OOC)_2CHCH_2SCH_2CH(NH_2)COOH$ (2)

$H_3COCO.CH(CH_3)CH_2SCH_2CH_2NH_2$ and (4)

$H_{11}C_5NHC(=O)SCH_2CH(NH_2)COOH$. (10)

* * * * *